US011397004B2

(12) United States Patent
Rudlinger

(10) Patent No.: US 11,397,004 B2
(45) Date of Patent: Jul. 26, 2022

(54) EMISSION-FREE DEVICES AND METHOD FOR PERFORMING MECHANICAL WORK AND FOR GENERATING ELECTRICAL AND THERMAL ENERGY

(71) Applicant: RV LIZENZ AG, Cham (CH)

(72) Inventor: Mikael Rudlinger, Baar (CH)

(73) Assignee: RV Lizenz AG

( * ) Notice: Subject to any disclaimer, the term of this patent is extended or adjusted under 35 U.S.C. 154(b) by 0 days.

(21) Appl. No.: 16/125,014

(22) Filed: Sep. 7, 2018

(65) Prior Publication Data

US 2019/0056106 A1 Feb. 21, 2019

Related U.S. Application Data

(62) Division of application No. 13/522,914, filed as application No. PCT/EP2011/050788 on Jan. 20, 2011, now Pat. No. 10,072,841.

(30) Foreign Application Priority Data

| | | |
|---|---|---|
| Jan. 22, 2010 | (EP) | 10151473 |
| Jan. 22, 2010 | (EP) | 10151481 |
| Feb. 23, 2010 | (EP) | 10154449 |

(51) Int. Cl.

| | |
|---|---|
| ***F23J 15/00*** | (2006.01) |
| ***F02M 25/03*** | (2006.01) |
| ***C10J 3/66*** | (2006.01) |
| ***C10K 1/04*** | (2006.01) |
| ***C10J 3/48*** | (2006.01) |

(52) U.S. Cl.

CPC ..... *F23J 15/006* (2013.01); *C10J 3/485* (2013.01); *C10J 3/66* (2013.01); *C10K 1/04* (2013.01); *F02M 25/03* (2013.01); *C10J 2300/0969* (2013.01)

(58) Field of Classification Search

CPC ..... F23J 15/006; F02M 25/03; C10J 3/485; C10J 3/66; C10J 2300/0969; C10K 1/04

See application file for complete search history.

(56) References Cited

U.S. PATENT DOCUMENTS

| | | | | |
|---|---|---|---|---|
| 3,672,341 A | 6/1972 | Smith | ..... | 123/25 C |
| 3,861,484 A | 1/1975 | Joslin | ..... | 180/65.235 |

(Continued)

FOREIGN PATENT DOCUMENTS

| | | | |
|---|---|---|---|
| CN | 201377352 Y | * | 1/2010 |
| CN | 201377352 Y | | 1/2010 |

(Continued)

OTHER PUBLICATIONS

"Carbon Capture Strategy Could Lead to Emission-Free Cars," Georgia Tech News Center, Feb. 11, 2008 (Year: 2008).*

(Continued)

*Primary Examiner* — Audrey B. Walter

(74) *Attorney, Agent, or Firm* — Ostrolenk Faber LLP

(57) ABSTRACT

The device for performing mechanical work and/or producing electrical or thermal energy, the energy necessary for operation is obtained from the oxidation of carbonaceous fuels into carbon dioxide and water. The device comprises means for compression and/or condensation of the exhaust gas, and storage means for receiving the compressed and/or condensed exhaust gas.

2 Claims, 5 Drawing Sheets

(56) References Cited

U.S. PATENT DOCUMENTS

| | | | | |
|---|---|---|---|---|
| 4,092,825 | A | 6/1978 | Egan | 60/39.02 |
| 4,660,465 | A | 4/1987 | Jentzch et al. | 98/115.4 |
| 5,034,021 | A | 7/1991 | Richardson | 48/77 |
| 6,202,574 | B1 | 3/2001 | Liljedahl et al. | 110/233 |
| 2003/0083390 | A1 | 5/2003 | Shah et al. | 518/702 |
| 2003/0097840 | A1 | 5/2003 | Hsu | |
| 2003/0121481 | A1* | 7/2003 | Dodd | C01B 3/323 123/3 |
| 2006/0115691 | A1 | 6/2006 | Hilmen et al. | 429/13 |
| 2008/0223332 | A1 | 9/2008 | Marco | 123/25 R |
| 2009/0020052 | A1 | 1/2009 | Becchetti et al. | 110/246 |
| 2009/0178642 | A1 | 7/2009 | Huang | 123/25 |
| 2009/0260363 | A1* | 10/2009 | Moriarty | F01K 23/10 60/719 |
| 2009/0297993 | A1 | 12/2009 | Fan et al. | 60/39.511 |

FOREIGN PATENT DOCUMENTS

| | | | |
|---|---|---|---|
| DE | 10 2007 041 624 | A1 | 3/2009 |
| EP | 0 751 045 | A2 | 1/1997 |
| EP | 1 167 860 | A2 | 1/2002 |
| EP | 2 325 288 | A1 | 5/2011 |
| RU | 2055997 | C1 | 3/1996 |
| RU | 2 069 274 | C1 | 11/1996 |
| RU | 2 516 725 | C2 | 5/2014 |
| SU | 707532 | | 12/1979 |
| TW | M337621 | U | 8/2008 |
| WO | WO 00/70262 | | 11/2000 |
| WO | WO 2009/144369 | A2 | 12/2003 |
| WO | WO 2004/054029 | A1 | 6/2004 |
| WO | WO 2006/117824 | A1 | 11/2006 |
| WO | WO 2007/079381 | A2 | 7/2007 |
| WO | WO 2011/061299 | A1 | 3/2011 |

OTHER PUBLICATIONS

International Search Report dated Aug. 23, 2011 issued in corresponding international patent application No. PCT/EP2011/050788.

* cited by examiner

EMISSION-FREE DEVICES AND METHOD FOR PERFORMING MECHANICAL WORK AND FOR GENERATING ELECTRICAL AND THERMAL ENERGY

CROSS REFERENCE TO RELATED APPLICATIONS

This is a divisional application of application Ser. No. 13/522,914, filed Aug. 20, 2012, which is a 35 U.S.C. § 371 National Phase conversion of PCT/EP2011/050788, filed Jan. 20, 2011, which claims the benefit of European Patent Application No. 10151473.5, filed Jan. 22, 2010, European Patent Application No. 10151481.8, filed to Jan. 22, 2010 and European Patent Application No. 10154449.2, filed Feb. 23, 2010, the disclosures of which are incorporated herein by reference. The PCT International Application was published in the German language.

BACKGROUND

Field of the Disclosure

The invention relates to emission-free devices and methods for performing mechanical work and producing electric and thermal energy, and systems for the fuel supply of mobile and static devices.

Related Art

In the course of the increasing mobility and the environmental pollution which it entails, for some time now, there has existed a need for drive devices, in particular combustion engines, with a reduced emission of pollutants such as for example nitrogen oxides, carbon monoxide and volatile organic compounds. For this purpose, on the one hand efforts have been made to purify the exhaust gases with regard to pollutants, for example with filters and catalytic convertors, and on the other hand to reduce the formation of these pollutants.

With the use of fuels based on hydrocarbons, such as petrol, diesel or natural gas, carbon dioxide is an unavoidable end product of the combustion process. It has been known for some time now that carbon dioxide has very negative effects on the climatic balance of the earth and contributes greatly to man-made global warming. The avoidance of carbon dioxide emissions is therefore very desirable.

Generally filtering of carbon dioxide out of combustion exhausts is difficult to achieve with a reasonable expense with regard to energy. For large-scale industrial application, systems are tested in which the carbon dioxide for example is captured in amine-based solvents. Such systems, however, are expensive and complicated, and are not practical for smaller installations. For reducing carbon dioxide emissions, furthermore, combustion engines with a lower fuel consumption and thus with a lower carbon dioxide emission have been developed, or fuels are used that are carbon dioxide neutral and are based on biomasses.

Electrically operated vehicles are completely emissions-free, at least locally. But even the battery systems available today are still quite heavy, which is to say their energy density is too small, which limits the maximum achievable range. Moreover, battery-operated vehicles are inferior to vehicles with chemical fuels in regard to recharging time and refuelling time.

Alternatively, fuel cell systems have been developed for methods for producing electrical energy for the operation of electrically driven vehicles. In said fuel cell systems, electricity is produced electrochemically from hydrocarbon-based fuels and air oxygen. Here too however, the reaction product of carbon dioxide results.

One can avoid the emission of carbon dioxide with the use of hydrogen as a fuel for internal combustion engines or fuel cells. Hydrogen however, has a lower energy density than liquid fuels based on hydrocarbons and also causes specific problems with production and storage.

A multitude of technologies, which have been established for years, are available in the state of the art for combustion engines. Instead of having to develop completely new technologies, it would be desirable to be able to modify these existing technologies such that the emission of carbon dioxide may be reduced or avoided.

SUMMARY

It is the object of the invention to provide emission-free devices and methods for performing mechanical work and/or producing electrical and/or thermal energy, which do not have the above-mentioned and other disadvantages. In particular, such a device and method should have greatly reduced emissions or even no emissions.

Another object of the invention is to provide a device and a method that permit to efficiently capture the accruing carbon dioxide and other emissions and to store it for a further use, final storage or recycling.

A further object of the invention is to provide a device and a method that can be operated with a closed cycle. These and further objects are achieved by a device according to the invention, devices which are operated with such devices, in particular mobile and stationary machines and installations, a method according to the invention for performing mechanical work and for the production of electrical or thermal energy, a fuelling installation according to the invention, a system for the fuel supply of such mobile and static machines, as well as a method according to the invention for the supply of one or more consumers with fuel, according to the independent claims. Further advantageous embodiments are given in the dependent claims.

In a device according to the invention for performing mechanical work and/or for the production of electrical or thermal energy, the energy that is necessary for operation is obtained from the oxidation of carbonaceous fuels into a exhaust gas consisting essentially of carbon dioxide and water. A device for compression and/or condensation of the exhaust gas is provided. A storage means receives the compressed and/or condensed exhaust gas.

Such a device according to the invention can be operated with oxygen-enriched air, advantageously with an oxygen content of >95%, and/or with pure oxygen as an oxidant.

A heat exchanger for cooling the exhaust gas flow can be provided upstream and/or downstream of the device for compressing and/or condensation of the exhaust gas.

Another embodiment of a device according to the invention comprises a device for the condensation and/or the separation of water out of the exhaust gas.

The device according to the invention can be realized as a fuel cell, as a thermal engine, for example as a piston engine or a turbine, or as a heating device.

One embodiment of the device according to the invention, realized as a thermal engine, is advantageously an internal combustion engine with at least one combustion chamber for the combustion of liquid or gaseous fuel with oxygen-enriched air or oxygen, with means for converting the arising gas pressure or gas volume into mechanical work, with a feed device for bringing oxygen into the combustion chamber, and with an exhaust device for the removal of exhaust gases from the combustion chamber. A compressor for compressing the exhaust gases and/or a condensation device for the partial condensation of exhaust gases is provided downstream of the feed device.

A further variant of such a device according to the invention comprises a feed device for bringing water into the combustion chamber and/or into the exhaust gas flow downstream of the exhaust device the combustion chamber.

An embodiment of a device according to the invention realized as a heating device comprises at least one combustion chamber for combusting fuel with oxygen-enriched air or oxygen, means for transferring the resulting thermal energy to a fluid heat transport medium, a feed device for bringing oxygen into the combustion chamber, and an exhaust device for removing exhaust gases from the combustion chamber. Downstream of the exhaust device a compressor for compressing the exhaust gases and/or a condensation means for partially condensing the exhaust gases is provided.

A machine according to the invention, in particular a mobile or stationary machine, and a device or installation according to the invention for heating buildings, particularly a district heat station, comprises such a device according to the invention.

A fuelling installation according to the invention, for fuelling a mobile machine or with a device according to the invention with gaseous or liquid fuels, comprises means for the removal of compressed gases, in particular carbon dioxide, from a storage means of the mobile machine.

Advantageously, such a fuelling installation also comprises means for fuelling the mobile machine or installation with oxygen-enriched air or oxygen.

A supply system according to the invention for the supply of one or more consumers with gaseous and/or liquid fuels comprises a first supply network for the transport of the fuels to the consumers, from one or more production installations and/or from one or more first storage means. A second return network serves for the return transport of exhaust gases, in particular carbon dioxide, from the consumers to one or more production installations and/or to one or more second storage means.

With an advantageous method for performing mechanical work and/or the production of electrical or thermal energy, the energy necessary for operation is obtained from the oxidation of carbonaceous fuels into an exhaust gas which consists essentially of carbon dioxide and water. The exhaust gases arising with the oxidation reaction are compressed and/or condensed, and are captured in a storage means.

Advantageously, oxygen-enriched air, advantageously with an oxygen content of >95%, or pure oxygen is used as an oxidant. Such a method is advantageously carried out with a device according to the invention.

With another embodiment variant of a method according to the invention, the compressed exhaust gases are cooled before and/or after compression and/or condensation.

With a further variant of the method according to the invention, water is condensed out and/or separated from the exhaust gases.

Advantageously, a method according to the invention is carried out with a fuel cell, or a thermal engine, or a heating device.

In a further advantageous embodiment variant of a method according to the invention, the fuels are manufactured by a method for the thermo-chemical utilisation of carbonaceous starting materials, in which in a first stage the carbonaceous starting materials are pyrolysed and pyrolytic coke and pyrolytic gas result. In a second stage, the pyrolytic coke from the first stage is gasified and synthesis gas results, and slag and other residual substances remain and are led away. In a third stage, the synthesis gas from the second stage is converted into the fuels; wherein excess recycle gas from the third stage is led into the first stage and/or the second stage. The three stages form a closed cycle.

A method and an installation for the thermo-chemical processing and utilisation of carbonaceous substances are disclosed in the international application No. PCT/EP2010/067847 of the applicant from 19 Nov. 2010, having the title "Verfahren und Anlage zur thermisch-chemischen Verarbeitung und Verwertung von kohlenstoffhaltigen Substanzen" (English translation of title: "method and device for the thermo-chemical treatment and utilization of carbonaceous materials"). The disclosure of this application forms an integral part of the description of the invention claimed in the present application.

In yet a further advantageous variant of a method according to the invention, at least a part of the exhaust gases are utilised in a method for the thermo-chemical utilisation of carbonaceous starting materials, in which in a first stage the carbonaceous starting materials are pyrolysed and pyrolytic coke and pyrolytic gas result. In a second stage, the pyrolytic coke from the first stage is gasified and synthesis gas results, and slag and other residual substances remain and are led away. In a third stage, the synthesis gas from the second stage is converted into fuel; wherein excess recycle gas from the third stage is led into the first stage and/or the second stage. The three stages form a closed cycle. The exhaust gases are fed into the first stage, and/or into the second stage and/or into the third stage.

Preferably, the exhaust gases are fed into the recycle gas.

In a method according to the invention for the supply of one or more consumers which carry out a method according to the invention, with gaseous and/or liquid fuels for this method, the consumers are supplied by a first supply network with gaseous and/or liquid fuels from one or more production installations and/or from one or more first storage means. With a second return network, at least a part of the exhaust gases occurring with the drive method, in particular carbon dioxide, is led back from the consumers to one or more production installations and/or to one or more second storage means.

With a method according to the invention for the production of electricity, the drive energy for the electricity generator is produced by a method according to the invention that is discussed above.

BRIEF DESCRIPTION OF THE DRAWINGS

In order to facilitate a fuller understanding of the present invention, reference is now made to the appended drawings. These references should not be construed as limiting the present invention, but are intended to be exemplary only.

DETAILED DESCRIPTION OF THE EMBODIMENTS

The examples specified hereinafter are given for an improved illustration of the present invention, but are not to restrict the invention to the features which are disclosed in them.

As already explained, with the method and the device 1 according to the invention for performing mechanical work and/or for the production of electrical or thermal energy, the energy required for the operation is obtained from the oxidation of carbonaceous fuel into exhaust gas. The exhaust gas resulting from the oxidation reaction is compressed and/or condensed and is captured in a storage means. The utilisation of chemical energy is effected thermo-chemically or electro-chemically. Such methods and devices 1 according to the invention have a closed cycle, which means that no emissions into the atmosphere arise.

The residual substances which occur with the performance of mechanical work or production of electrical or thermal energy, such as in particular carbon dioxide, are aftertreated, compressed, and stored in a space-saving manner, for example in a pressure tank. The stored gas mixture essentially contains only carbon dioxide, and as the case may be water. The carbon dioxide is regularly relocated into a suitable, larger storage device for further utilisation. Advantageously, this leading back of the carbon dioxide is effected at the same time as the fuelling of a vehicle.

In one advantageous variant of a method and a device according to the invention, the stored carbon dioxide is partly or completely recycled.

Figure 1:
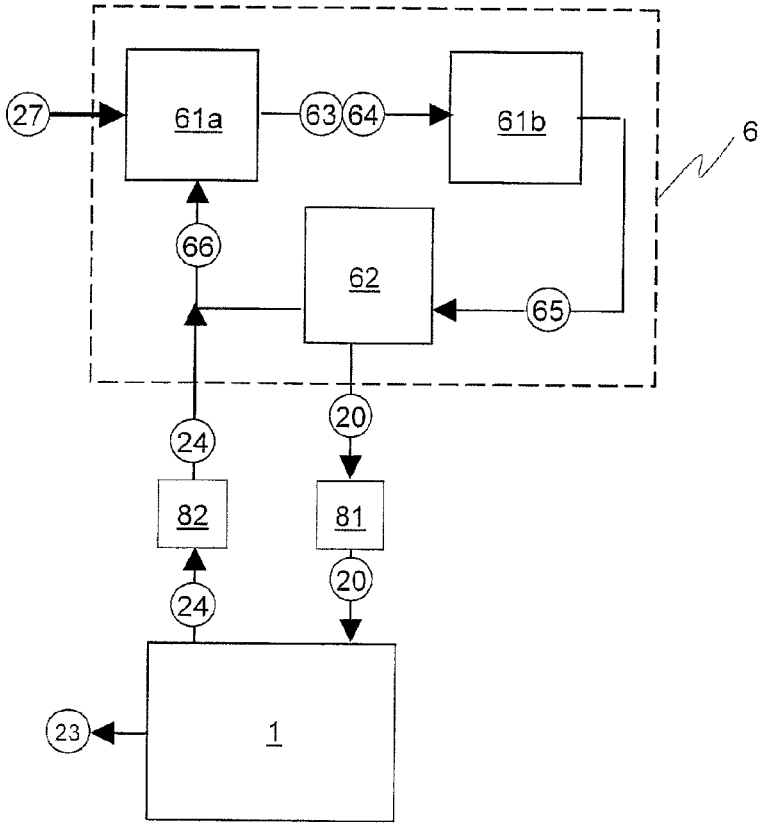
FIG. 1 schematically shows a device according to the invention, in combination with an installation for the thermo-chemical utilisation of carbonaceous substances, wherein an essentially closed materials cycle results.

In the international application No. PCT/EP2010/067847 of the applicant, a method and an installation for the thermo-chemical treatment and utilization of carbonaceous materials is disclosed. FIG. 1 depicts such an installation 8 in a schematic and strongly simplified manner.

In an essentially closed circuit, in the installation 6 carbonaceous starting material 27 is converted into hydrocarbons 20 and hydrocarbon derivatives. For that purpose in a first stage 61*a* and a second stage 61*b* the carbonaceous starting material 27 is converted into synthesis gas mixture 65. In a first stage 61*a* the carbonaceous substances are provided and pyrolysed and pyrolytic coke and pyrolytic gas result. In a second stage 61*b*, the pyrolytic coke from the first stage is gasified and synthesis gas mixture 65 results, and slag and other residual substances remain. In a third stage 62, hydrocarbons and other valuable materials 20 are produced from the synthesis gas mixture 65, which can be used for other purposes, for example as liquid and/or gaseous fuels 20. The recycle gas mixture 66 that remains after the synthesis stage 62 essentially comprises carbon dioxide, and is led back into the first stage as a gasification agent. The three stages are pressure-resistantly closed, and form an essentially closed cycle. With such an utilisation installation 6, solid, liquid and gaseous substances can be efficiently converted into gaseous or liquid fuels 20. In addition the installation 6 produces thermal energy in the form of process steam (not shown). The carbonaceous fuels produced in the synthesis stage 62 are preferably stored intermediately 81, in tanks of pressure storage means.

A device 1 according to the invention advantageously uses as a fuel gaseous or liquid hydrocarbons and hydrocarbon derivatives 20 from the installation 6. The oxidation reaction producing thermal or electrical energy is effected with oxygen-enriched air, advantageously with an oxygen content >95%, or pure oxygen 22 instead of air. The oxygen is advantageously carried along in a pressure tank. A device 1 according to the invention can for example be an internal combustion engine, in which the heat resulting from the oxidation reaction is converted in a thermal engine into mechanical work, or a fuel cell in combination with an electric motor, in which the oxidation reaction is directly utilised for the production of electricity.

The use of pure oxygen 22 instead of air on the one hand avoids the formation of nitrogen oxides, due to the absence of air nitrogen in a thermo-chemical reaction at high temperatures. Above all, however, in the occurring reaction products 21 remain essentially only carbon dioxide 24 and water vapour 23. Depending on the stochiometrics of the reaction, the occurring gases can also contain certain fractions of carbon monoxide and unreacted fuel. These can be subsequently aftertreated analogously to the carbon dioxide.

The reaction products 21 of the energy producing reaction are essentially gaseous. The respective gas mixture is then compressed in order to reduce the volume. The gas mixture 21 is cooled with the help of a heat exchanger before and/or after the compressing, by which means it further reduces its volume. Water is condensed out, by which means the volume of the gas mixture is reduced once more, and only carbon dioxide 24 remains in the gas mixture, and as the case may be, with fractions of carbon monoxide and unreacted fuel. The condensed water 23 is separated. The carbon dioxide 24 can be intermediately stored in a suitable reservoir, for example in a pressure tank.

At regular intervals the carbon dioxide 24 is again fed to the first step 61*a* of the installation 6, so that a closed material cycle for the carbon dioxide results. An intermediary storage means 82 for the exhaust gas containing carbon dioxide can be provided. With the method mentioned above it is thus possible to produce liquid or gaseous hydrocarbons and hydrocarbon derivatives from carbonaceous substances and carbon dioxide, and to subsequently convert the resulting fuel mixture in a device 1 according to the invention into mechanical work and/or electrical or thermal energy. The captured and stored carbon dioxide is led back and is partly or completely converted into fuel 20 again in the installation 6. In this manner, the effective carbon dioxide emission of a device according to the invention can be greatly reduced or even avoided.

Alternatively or additionally to the recycling, a part of the stored carbon dioxide can be deposited in a way and manner such that it is permanently prevented from getting into the atmosphere. Corresponding technologies for the permanent, long-term storage of carbon dioxide are being developed worldwide at present. For example, the final storage of carbon dioxide by way of pumping into empty oil fields and natural gas fields is being tested.

Figure 2:
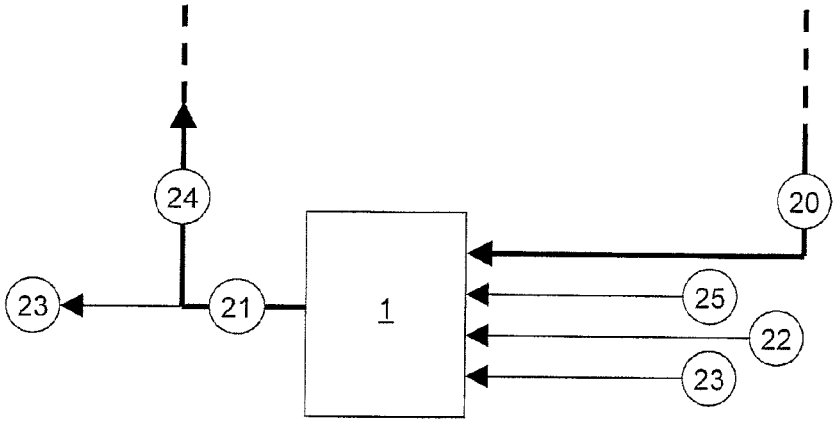
FIG. 2 schematically shows one variant of a device according to the invention.

A further, generalised variant of a device 1 according to the invention for carrying out a method according to the invention is schematically represented in FIG. 2. Such a combustion engine device according to the invention can be operated without problem in a combined operation with hydrogen 25 as a further fuel. In such a case, the hydrogen fraction leads to a reduction of the occurring residual gas quantity after the heat exchanger or compressor, since in any case only water results from the oxidation of hydrogen with oxygen.

If a device 1 according to the invention is designed as an internal combustion engine, then in an advantageous variant of such a device or method according to the invention, water 23 can be used as an additional expansion means. For this purpose, after igniting the combustion process, for example after the self-ignition of the compressed fuel-air mixture in a diesel motor, a certain quantity of water is injected into the cylinder. This water, which is preferably atomised in a fine manner, is subsequently evaporated by way of the thermal energy of the exothermic oxidation reaction. The resulting gas pressure increase or gas volume increase on account of the water vapour thus contributes to the production of kinetic energy, wherein simultaneously the temperature of the complete mixture of combustion exhaust gases and water vapour is reduced. This, however, is of no problem or is even desirable, since significantly higher reaction temperatures arise on account of the greater energy density of a reaction with pure oxygen, which improves the thermodynamic efficiency, but can also strain parts of a device 1 according to the invention to a greater extent.

Alternatively, the water can be introduced as steam. Furthermore a certain fraction of liquid water can also be supplied mixed with the liquid fuel. At high temperatures, superheated water vapour acts as an additional oxidant in addition to oxygen.

The manner of functioning of a method according to the invention is hereinafter described and explained in more detail by way of the example of a device 1 according to the invention, in the form of a piston engine. Analogously, devices according to the invention designed as internal combustion engines can also be designed as turbines or Wankel engines, etc. The hot exhaust gases are used for the performance of mechanical work, in accordance with the functioning principle of the respective type of an internal combustion engine, and are thereby partly expanded. Subsequently the gas mixture leaves the combustion chamber. With an internal combustion engine according to the invention designed as a four-stroke piston engine, for example, the exhaust gas mixture is ejected from the cylinder with the third stoke and subsequently compressed, cooled and intermediately stored.

Figure 3:
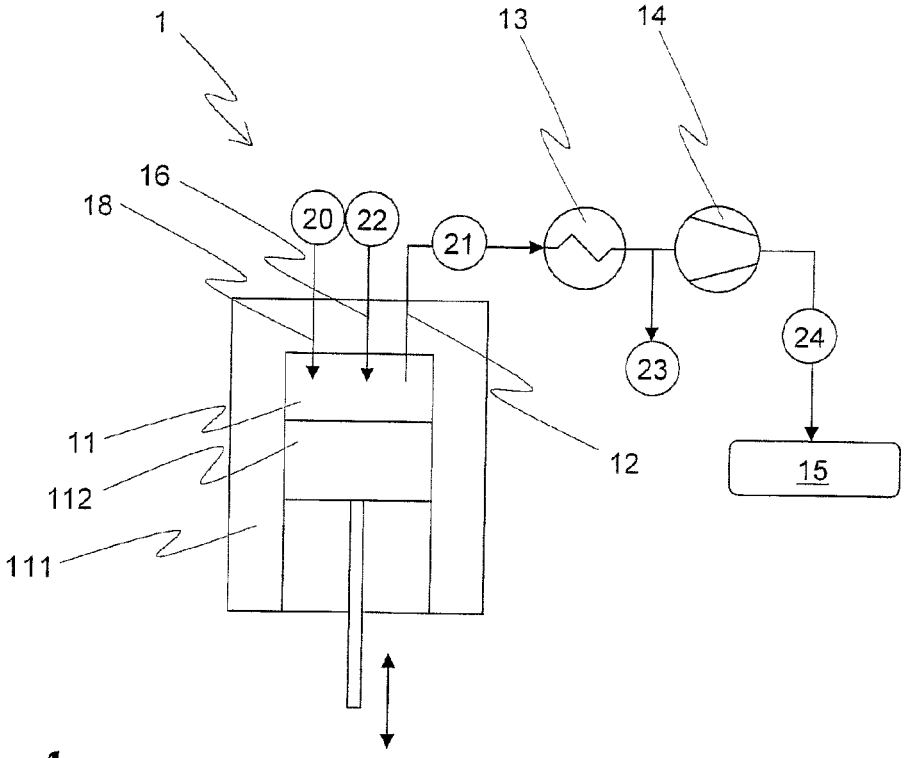
FIG. 3 schematically shows one embodiment of a device according to the invention, realized as an internal combustion engine.

One possible embodiment of a device 1 according to the invention for carrying out a method according to the invention, designed as an internal combustion engine, is schematically represented in FIG. 3, with the example of a piston engine with one cylinder. The depicted internal combustion engine 1 comprises a cylinder 111 and a piston 112, which is movably arranged therein, and which together form a closed combustion chamber 11. In a first stroke, oxygen 22 is brought into the expanding fuel chamber 11 with a feed device 16, which is merely shown in a schematic manner. Subsequently, in a second stroke, the oxygen 22 is compressed, and at the end of the second stroke the fuel 20 is brought into the combustion chamber 11 with a feed device 18, and is combusted. With the subsequent third stroke, the expanding exhaust gases 21 performing mechanical work, and with the fourth stroke, the party expanded exhaust gases 21 are led away out of the combustion chamber 11 by way of an exhaust device 12, which is not shown in detail.

The hot exhaust gases 21, which consist essentially only of carbon dioxide and water vapour, are subsequently cooled in a heat exchanger 13 arranged downstream. By way of this, the volume of these exhaust gases 21 is reduced. A part of the water 23 is condensed out by way of the cooling, and is separated. The residual gas, which consists now only of carbon dioxide 24 and, as the case may be, the residual fractions of carbon monoxide and unreacted fuels, is compressed in a compressor 14 arranged in series and is pumped into a storage means 15, in the simplest case into a pressure container. The condensation stage 13 before the compressing 14 reduces the undesired formation of condensation water droplets in the compressor 14.

The depicted combustion engine 1 according to the invention has no emissions. Since the device is not operated with air or similar mixtures, also no air-specific pollutants can arise, such as for example nitrogen oxides. The water that arises with the combustion is not problematic and can be separated. The carbon dioxide and other residual gases are captured in the storage means 15 and stored for further use. Uncombusted fractions of the fuel are either condensed out with the water and separated, or are compressed together with the carbon dioxide.

Apart from the basic elements C, H, O, in the fuels for a device according to the invention sulphur and phosphorus can also be present, depending on the degree of quality. The sulphur for example can react during combustion into sulphur dioxide and sulphur trioxide, which in turn reacts with the water into sulphurous acid and sulphuric acid. These corrosive pollutants, together with the water can be condensed out, separated away and disposed off. The same applies to phosphorus-containing pollutants and, as the case may be, arising fine dust particles.

Figure 4:
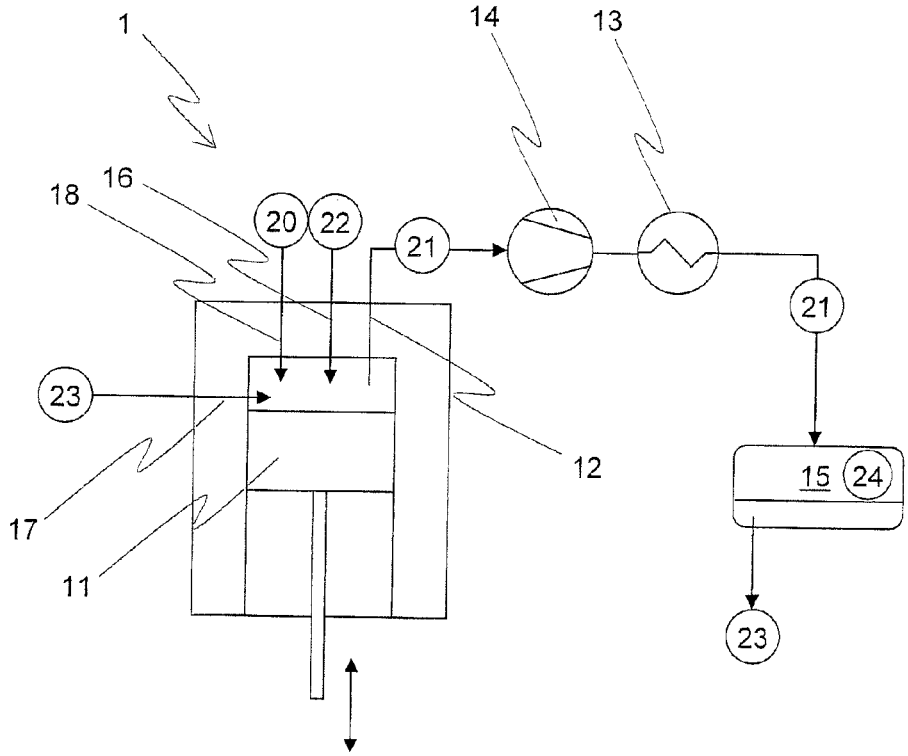
FIG. 4 schematically shows another embodiment of a device according to the invention, realized as an internal combustion engine.

A further possible embodiment of a device 1 according to the invention for carrying out a method according to the invention, designed as an internal combustion engine, is schematically represented in FIG. 4. In this variant, water is brought into the combustion chamber 11 by way of a feed device 17, which is represented merely in a schematic manner.

This is effected preferably in a manner such that during or after the combustion reaction, a certain quantity of liquid or vaporous water 23 is injected into the combustion chamber and is finely distributed. This water is heated by way of the combustion heat, by which means the complete gas volume increases in the combustion chamber 11, and thus also the gas pressure or gas volume which is available for the performance of mechanical work. Accordingly then, given a constant power, the quantity of fuel can be reduced.

Alternatively or additionally, water can also be brought into the exhaust gas flow 21 when it has left the combustion chamber 11. Such a variant has the advantage that the combustion reaction in the combustion chamber can run in an efficient manner at temperatures as to high as possible, and simultaneously the resulting temperature of the exhaust gas flow is so low that the downstream devices 13, 14 are not strained too much.

The quantity of water and the point in time of the injection are thus matched to the feed of fuel 21 and oxygen 22, such that the combustion reaction can take place in an efficient manner. Advantageously, the resulting temperature during the oxidation reaction is essentially such that an as high as possible thermodynamic efficiency of the thermal engine is achieved. The larger the quantity of applied water, the lower is further the relative fraction of carbon dioxide in the reaction gases, which reduces the gas quantity that remains after condensing out the water, and which is to be compressed.

In the device 1 depicted in FIG. 4, the exhaust gases 21 are first compressed in a compressor 14 before they are subsequently cooled in a heat exchanger 13. The water 23 remains in the gas mixture 21 and collects in liquid form in the pressure container 15. The water 23 can simultaneously be discharged with the regular emptying of the carbon dioxide 24. The variant show in FIG. 4 can also be combined with the internal combustion engine 1 without water injection from FIG. 3, and vice versa, and can be generally used for a device 1 according to the invention.

The energy that is necessary for the operation of the compressor of a device 1 according to the invention is advantageously produced by the device according to the invention itself. As a result of this, the achievable efficiency of the device according to the invention is reduced. However, simultaneously the emission-free nature of the device and method according to the invention is achieved. Moreover, given the same engine dimensions, the achievable power is larger, which again compensates the power loss.

The compressor can for example be operated via a suitable gear directly with a crank shaft of a piston internal combustion engine. If the device 1 according to the invention is designed as a turbine, then the compressor can be seated directly on the same shaft. The exhaust gases can then be condensed directly subsequently to the expansion procedure, and the remaining residual flow can be compressed.

In another variant of a device according to the invention, designed as a piston engine, the exhaust gases get already precompressed within the combustion chamber 12 with the third stroke, and then are discharged through the exhaust device 12. The compressor 14 arranged downstream can also be omitted, as the case may be.

Such an embodiment is also possible as a two-stroke variant, since the new charging of the combustion chamber with a reaction mixture (fuel 20, oxygen 22, water 23) in a device according to the invention can be effected very quickly. In a second upwards stroke, the exhaust gases are precompressed and are let out of the combustion chamber towards the end of the stroke. The gaseous oxygen can be blown into the combustion chamber under high pressure at the end of the upwards stroke, since one requires comparatively little oxygen for a complete combustion reaction, and water is present as an additional expansion means. The liquid fuel 20 and the water 23 as an expansion means can in any case be injected into the combustion chamber in a very rapid manner and under high pressure.

The energy consumption for the compressor can be optimised by way of a suitable combination with one or more heat exchangers or cooling elements, in which the gas volume can be reduced by way of the release of the thermal energy of the reaction gases to an internal or external heat sink.

It is likewise possible to realise a device 1 according to the invention as a thermal engine with external combustion, for example as a steam engine or steam turbine or as a Sterling motor.

Figure 4A:
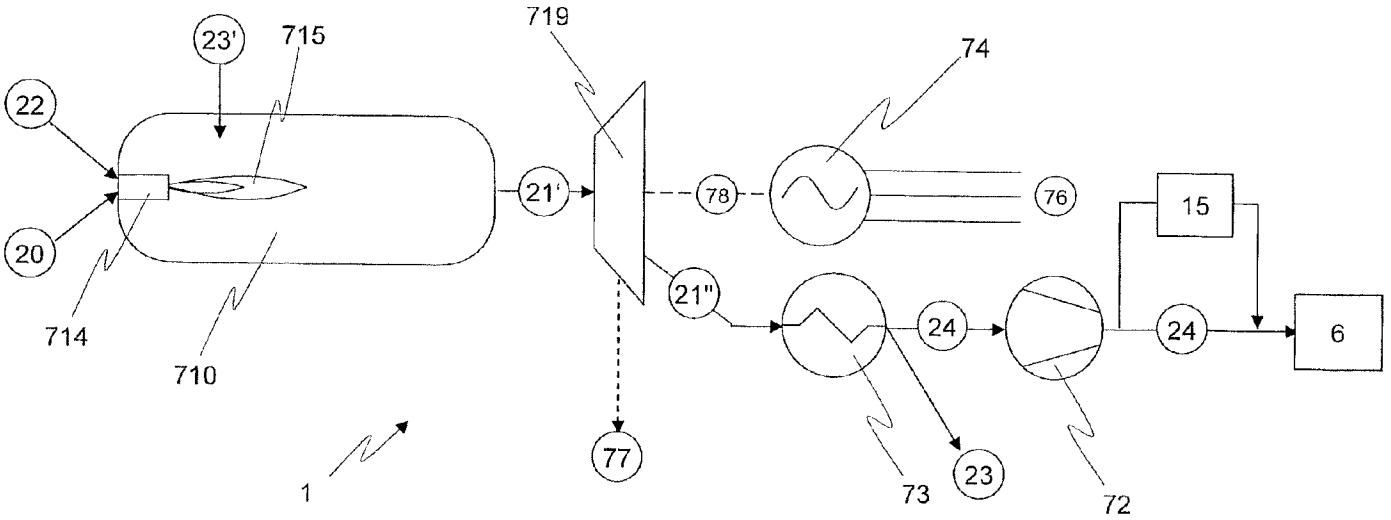
FIG. 4A schematically shows a device according to the invention realized as a combined gas/steam turbine.

FIG. 4A shows another advantageous embodiment variant of such a drive device 1 according to the invention, which is designed as a combined gas/steam turbine. Such a drive device is particularly suitable for ships or power plants.

In a combustion chamber 710 connected ahead of the turbine, fuel 20 is burned with oxygen 22 in a burner 714, producing a very hot exhaust gas. Water 23' is brought into the combustion chamber 710, preferably as overheated liquid water with a temperature of, for example, above 250° C., and a pressure of 50 bar. The resulting water vapour mixes with the combustion exhaust gases, resulting in a hot (e.g. 600° C.) exhaust gas 21' with a large fraction of overheated water vapour. Said exhaust gas leaves the combustion chamber 710 and is converted into mechanical work 78, in a following turbine device 719, which again drives an electric generator assembly 74. Depending on the design of the device, the gas mixture in the combustion chamber behaves isochorically, such that the gas pressure increases, or isobarically, such that the gas volume increases accordingly, or both the volume and the pressure increase. The subsequent turbine device 719 has to be designed correspondingly. Suitable turbines 719 are known from the prior art, and generally comprise several stages. In an alternative variant, partially expanded process steam 77 can be removed after a high pressure stage of the turbine device 719, and used otherwise.

The expanded exhaust gas 21" is led into a condenser/economizer 73, where the water is condensed out and separated. The remaining recycle gas 24, which essentially comprises carbon dioxide, is compressed in a compressor 72. Subsequently it is stored intermediately in a gas storage means 15, or is directly conveyed into a first stage of a utilisation installation 6. The compressor 72 is advantageously driven via the turbine 719.

Instead into the combustion chamber 710, the water 23' can also be mixed into the exhaust gas stream 21' subsequent to the combustion chamber 710, for example with a Venturi nozzle.

In the drive device 71, the amount of water 23' and the amount of fuel mixture 20, 22 and the other parameters that can be chosen are advantageously adjusted to each other such that the subsequent turbine achieves an energy efficiency as high as possible. At the same time the amount of water in the exhaust gas mixture should be as high as possible. On the one hand, this way an as high as possible pressure drop of the gas mixture over the condenser 73 is achieved. This increases the total pressure difference over the turbine 719, and thus its efficiency. On the other hand, less recycle gas 24 remains that has to be compressed 72 and stored 15.

A further advantage of bringing water vapour into the combustion chamber is the cooling effect of the vapour. The exothermic oxidation of the very energy rich fuel mixture can lead to very high temperatures, of up to 1000° C. or even 2000° C. Such temperatures would strain very strongly the structures of the combustion chamber 719 and the following turbine device 719. The comparably cold water vapour is advantageously brought into the chamber in such a way that it shields the walls of the combustion chamber 710 from the very hot flame 715. The vapour eventually cools the complete gas mixture down to 600° C. to 800° C., which decreases the thermal strain of the turbine blades, and increases their life span.

Figure 5:
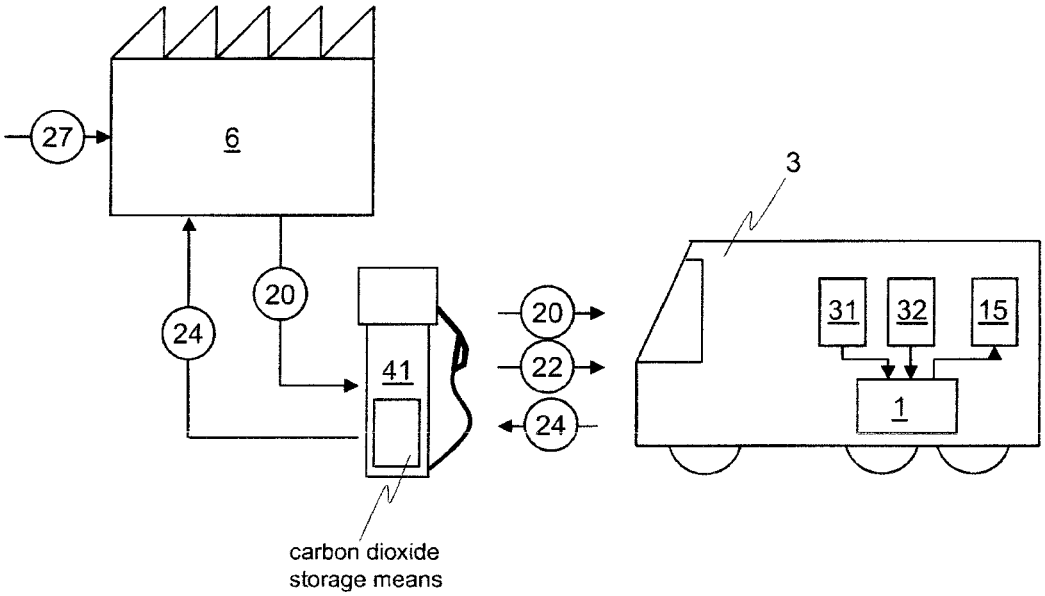
FIG. 5 schematically shows a device according to the invention in a vehicle, as well as a possible design of a closed cycle for the fuel supply of such a vehicle with a device according to the invention, in combination with a recirculation system to for carbon dioxide.
Figure 5A:
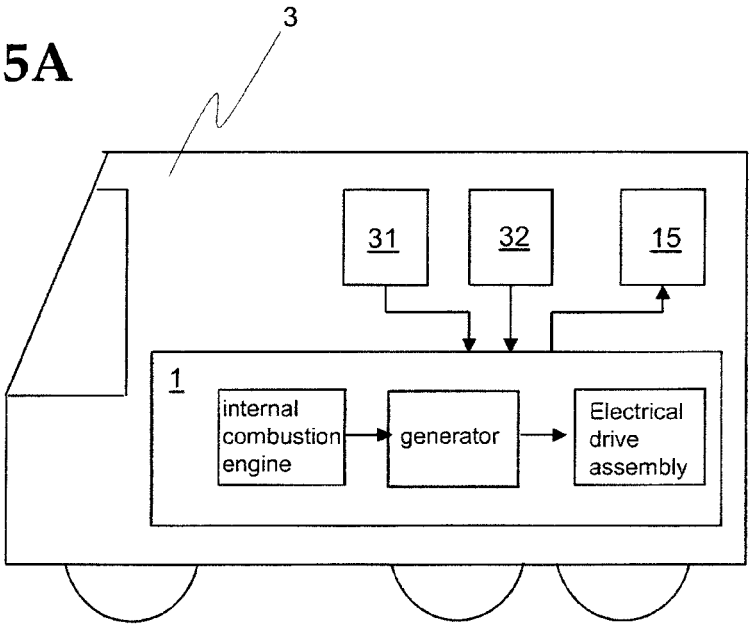
FIG. 5A schematically shows the vehicle 3 of FIG. 5 in greater detail FIG. 6 schematically shows one possible design of a supply network for gaseous fuels, in combination with a recirculation system for carbon dioxide, for carrying out the supply method according to the invention.

In addition to the already mentioned aspects, the shown drive device 1 differs from a conventional gas turbine in that no compressor is connected ahead of the combustion chamber. This allows a simpler design of the combustion chamber 710 than in a gas turbine. Since the fuels 20 are burned with pure oxygen 22, the achievable energy density is higher than with air, with its reduced oxygen content. To increase the amount of oxygen per time unit that can be brought into the combustion chamber 710, the oxygen ban be pressurized. The turbine device 719 can be designed like a steam turbine, since the temperature and pressure ranges of the exhaust gases 21' are essentially the same A vehicle 3 driven by a device 1 according to the invention is schematically depicted in FIG. 5, as an example for a mobile machine 3 according to the invention. A device 1 according to the invention, which is designed as an internal combustion engine, is either applied directly as a drive assembly or is alternatively operated in a constant manner in an ideal engine speed range, wherein electricity for an electrical drive assembly is produced by a generator (FIG. 5A). If the device 1 according to the invention is designed as a fuel cell system, an electric motor likewise serves as a drive assembly.

The vehicle 3 comprises a tank 31 for the liquid or gaseous fuel 20 as well as a pressure tank 32 for the oxygen 22. The gas storage means 15 for the carbon dioxide is advantageously designed as a pressure tank 15. A device 1 according to the invention is particularly suitable for less weight-sensitive vehicles, such as for example land and water vehicles, in particular vehicles for urban transport or ships and larger boats. It is also possible to produce oxygen on location, depending on the size of the vehicle, by which means the pressure tank 32 merely serves as an intermediate storage means and may be designed accordingly smaller.

Not shown in FIG. 5 is a possible reservoir for the water 23. Such a reservoir can be designed comparatively small. The condensed water which arises with the after-treatment of the exhaust gases can be recycled, by which means the effective water consumption and thus the size of the necessary reservoir is even smaller.

Likewise represented in FIG. 5 is a possible design of a closed cycle for the fuel supply of such a vehicle 3 according to the invention. For this purpose the vehicle 3 is charged at a suitably set-up fuelling installation 41, with liquid or gaseous fuel 20 as well as with compressed oxygen 22. At the same time, the carbon dioxide 24 collected in the gas storage means 15 is discharged into a suitable gas storage means of the fuelling installation 41.

In another embodiment of a device according to the invention, the thermal energy arising in the oxidation reaction is not converted into mechanical work, but is used to heat a fluid heat transport medium. This means that the device serves to produce thermal energy. For the heat transport medium, serving to transport the generated thermal energy, for example water, oil or steam can be used.

In a possible variant of such a device according to the invention, the energy producing oxidation reaction takes place in a suitably designed combustion chamber, which is equipped with means to heat the transport medium, for example a heat exchanger. These means also serves for cooling down the arising exhaust gas stream.

The heated heat transport medium subsequently can be used in industrial installations, or for heating buildings. For example, a district heating station or a block-type heating station, respectively, can be equipped with such a device according to the invention.

The fuelling installation 41 forms a closed cycle with the fuel production installation 6, as is disclosed in the international application No. PCT/EP2010/067847 of the applicant. The installation 6 produces liquid or gaseous hydrocarbon fuels 20 from carbonaceous starting materials 27. These fuels are transported to the fuelling installation 41 with suitable means. The carbon dioxide 24 in turn, as the case may be with fractions of carbon monoxide and unreacted fuel, which has been discharged from the vehicle 3 into the fuelling installation 41, is transported via suitable means to the installation 6 where it is fed into the closed cycle of the installation 6.

A fuelling installation 41 is particularly suitable for example for public bus transport enterprises. Generally, such buses are refuelled exclusively in the fuelling installations of the enterprise. Thus a large number of vehicles 3 can be reached with a comparatively low number of fuelling installations 41 to be retrofitted. This leads to lower investment costs in a corresponding total installation.

In regions that are spatially clearly defined, for example of a town, the recycling of the carbon dioxide and/or the supply with fuel can also be effected via a suitable supply network 5. With a method according to the invention, for the supply of one or more consumers with gaseous and/or liquid fuels for this method, the consumers are supplied by a first supply network with gaseous and/or liquid fuels from one or more production installations and/or form one or more first storage means. At least a part of the exhaust gases, in particular carbon dioxide, which occur with the drive method, are led with a second return network from the consumers to one or more production installations and/or to one or more second storage means.

Figure 6:
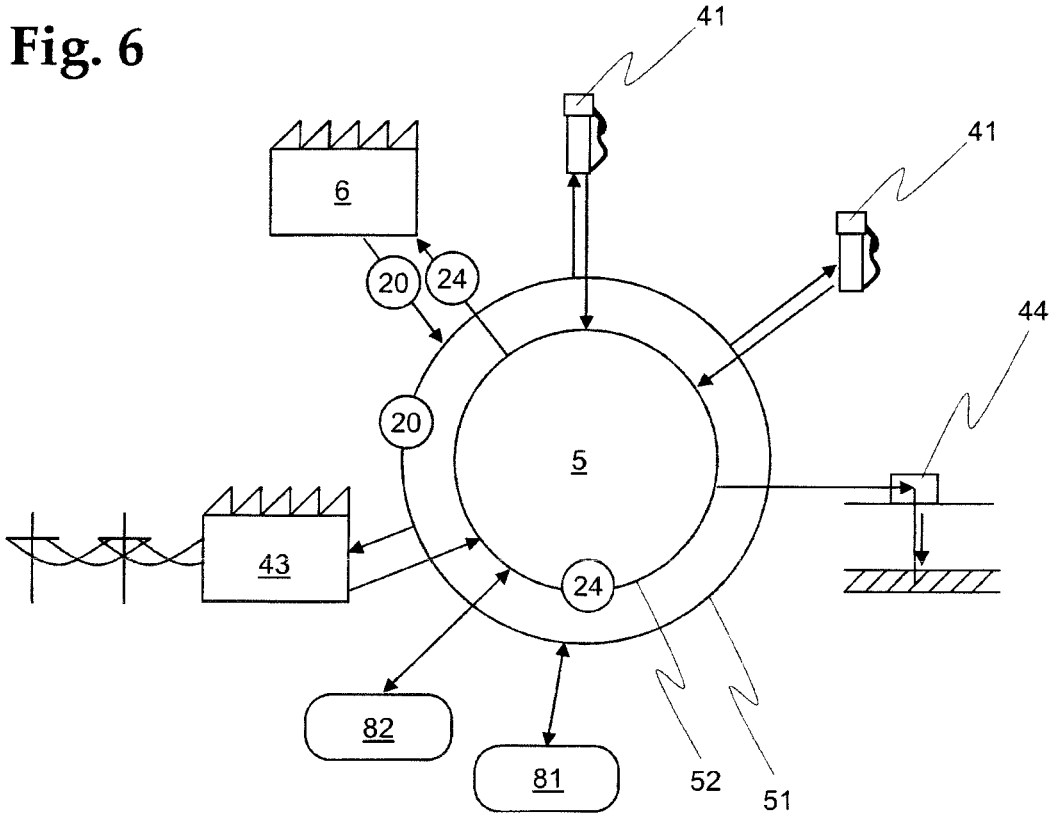

FIG. 6 shows a possible design of such a supply network for carrying out the supply method according to the invention. The system has two annular networks in the shown example. Gaseous or liquid fuel 29 is fed from a production installation 6 with a closed cycle into a first supply network 51. Different fuelling installations 41 obtain the gaseous or liquid fuels from this network 51. Likewise connected to the network 51 is first intermediate storage means 81, and an electricity power station 43, in which an electric generator is operated using a device according to the invention, as shown for example in FIG. 4A.

Additionally, a second return network 52 is present, into which the fuelling installations 41 and the electricity power station 43 feed the accruing carbon dioxide 24. The carbon dioxide in turn is led back to the production installation 6. A second intermediate storage means 82 serves for increasing the capacity of the second network. Additionally, a final storage 44 for carbon dioxide is provided in the shown variant. Carbon dioxide can be tapped from the second network and be pumped under pressure into an exhausted oil field, where it then remains permanently.

If a device according to the invention is connected to such a supply system 5 according to the invention, a fuel tank 31 and/or gas storage means 15 for the carbon dioxide can be completely omitted, since the fixed conduit system assumes this function. This is the case for example with the electricity production installation 43 in FIG. 6.

LIST OF REFERENCE NUMERALS

1 device
11 combustion chamber
111 cylinder
112 piston
12 exhaust device
13 heat exchanger
14 device for compressing, compressor
15 gas storage means
16 feed device for oxygen
17 feed device for water
18 feed device for fuel
20 fuel
21, 21', 21" reaction products, product gases, combustion gases, exhaust gases
22 oxygen
23, 23' water
24 carbon dioxide

25 hydrogen
27 carbonaceous starting materials
3 vehicle, mobile or stationary machine
31 fuel tank
32 oxygen tank
41 fuelling installation
43 installation for electricity production
44 final storage for carbon dioxide
5 supply system
51 supply network fuel
52 return network carbon dioxide
6 installation for the thermo-chemical utilisation of carbonaceous substances
61*a* first stage for producing synthesis gas mixture
61*b* second stage for producing synthesis gas mixture
62 third stage for producing hydrocarbon derivatives and other valuable materials
63 pyrolytic coke
64 pyrolytic gas
65 synthesis gas
66 recycle gas with carbon dioxide
71 device
710 combustion device
711 cylinder
712 piston
713 exhaust device
714 burner
715 flame
716 feed device for oxygen
717 feed device for water
718 feed device for fuel
719 turbine
72 compressor
73 condenser/economizer
74 generator device
75 external cooling circuit
76 electric energy
77 process steam
78 mechanical energy
81 first storage means, storage means for fuels
82 second storage means, storage means for exhaust gases

What is claimed is:

1. A fuelling installation for fuelling a mobile machine with gaseous or liquid fuels, wherein the mobile machine comprises a device for performing mechanical work and/or for producing electrical energy that obtains the energy necessary for operation from the oxidation of carbonaceous fuels into an exhaust gas consisting essentially of carbon dioxide and water, and wherein the mobile machine comprises a device for compressing and/or condensing the exhaust gas and a storage means in the form of a carbon dioxide pressure tank for receiving the compressed and/or condensed exhaust gas; and the fuelling installation comprises a gas storage means in the form of a carbon dioxide pressure tank for receiving carbon dioxide discharged from the carbon dioxide pressure tank of the mobile machine, the gas storage means of the fuelling installation being connected to a return network that transports carbon dioxide to another storage means; means for fuelling the mobile machine with oxygen or oxygen-enriched air; and a fuel tank that is connected to a supply network that supplies fuel to the fuel tank.

2. A fuelling installation for fuelling a mobile machine with gaseous or liquid fuels, wherein the mobile machine comprises a device for performing mechanical work and/or for producing electrical energy that obtains the energy necessary for operation from the oxidation of carbonaceous fuels into an exhaust gas consisting essentially of carbon dioxide and water, and wherein the mobile machine comprises a compressor and/or a condenser for receiving the exhaust gas and a storage in the form of a carbon dioxide pressure tank for receiving the compressed and/or condensed exhaust gas; and the fueling installation comprises a connection to a return network, the return network being a) configured for the removal of compressed gases, including said carbon dioxide, from the carbon dioxide pressure tank of the mobile machine and b) being connected to a production installation that produces fuel from said carbon dioxide; a supply network for fuelling the mobile machine with oxygen or oxygen-enriched air; and a connection to a fuel tank that is connected to a supply network that supplies fuel from the production installation that produces fuel from said carbon dioxide to the fuel tank.

* * * * *